US010716418B2

(12) United States Patent
Jaramillo

(10) Patent No.: US 10,716,418 B2
(45) Date of Patent: Jul. 21, 2020

(54) SECURABLE PILLOW

(71) Applicant: Irene Jaramillo, Cypress, TX (US)

(72) Inventor: Irene Jaramillo, Cypress, TX (US)

( * ) Notice: Subject to any disclaimer, the term of this patent is extended or adjusted under 35 U.S.C. 154(b) by 355 days.

(21) Appl. No.: 15/093,261

(22) Filed: Apr. 7, 2016

(65) Prior Publication Data

US 2017/0290450 A1 Oct. 12, 2017

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ..... A47G 9/10; A47G 9/1018; A47G 9/1027; A47G 9/1036; A47G 9/1045; A47G 9/1063; A47G 9/109
USPC ..... D6/595–605
See application file for complete search history.

(56) References Cited

U.S. PATENT DOCUMENTS 482,432 A * 9/1892 Ashaugh ..... A41D 13/081 2/66
784,857 A * 3/1905 Grushoff ..... A41D 13/081 2/66
2,727,241 A * 12/1955 Smith ..... A41D 13/081 2/66
2,877,472 A * 3/1959 Wagner ..... A47G 9/10 5/636
3,883,906 A * 5/1975 Sumpter ..... A47G 9/10 5/632
4,315,504 A * 2/1982 Drennan ..... A61F 13/102 128/881
4,408,355 A * 10/1983 Brock ..... A41D 13/081 2/66
4,495,659 A * 1/1985 Madnick ..... A41D 13/081 2/66
5,138,728 A * 8/1992 Aston ..... A47C 21/00 5/645
6,041,458 A * 3/2000 Vickers ..... A47G 9/10 5/490
6,336,236 B1 * 1/2002 Dalton ..... A47G 9/10 5/632
6,381,786 B1 * 5/2002 Cadden ..... A47D 13/083 5/646
6,513,179 B1 * 2/2003 Pan ..... A47G 9/109 5/636
D477,173 S * 7/2003 Nagy-Marczyk ..... D6/601
7,131,156 B1 * 11/2006 Walker-Craft ..... A47G 9/1045 5/639
D677,096 S * 3/2013 Shirian ..... D6/601
D696,529 S * 12/2013 Crawford ..... D6/601
8,615,814 B1 * 12/2013 Hawkins ..... A41D 19/01 2/66
D698,929 S * 2/2014 Strebeigh ..... D24/190
D711,159 S * 8/2014 Castellano ..... D6/601
8,931,127 B1 * 1/2015 Moses ..... A47C 27/142 2/65
8,984,688 B1 * 3/2015 Ibrahim ..... A47G 9/10 5/632

(Continued)

*Primary Examiner* — Eric J Kurilla
*Assistant Examiner* — Amanda L Bailey
(74) *Attorney, Agent, or Firm* — Norton Rose Fulbright US LLP

(57) ABSTRACT

A pillow with an internal sleeve for attaching the pillow to the user, and in particular, a user's limb. The pillow may include various ornamental or aesthetic additions.

19 Claims, 11 Drawing Sheets

(56) References Cited

U.S. PATENT DOCUMENTS

| | | | | |
|---|---|---|---|---|
| 9,226,605 | B1 * | 1/2016 | Castellano | A47G 9/0253 |
| D769,451 | S * | 10/2016 | MacMillan | D24/190 |
| 9,795,225 | B2 * | 10/2017 | Moses | A47C 27/142 |
| 2010/0299800 | A1 * | 12/2010 | Jackson, Jr. | A41D 13/081 2/69 |

* cited by examiner

SECURABLE PILLOW

TECHNICAL FIELD

The instant disclosure relates to pillows, and in particular, pillows including various cavities or fasteners which assist in attaching the pillow to the user.

BACKGROUND

The present invention relates to pillows for the purposes of providing comfort and support. More particularly, the present invention pertains to pillow attachments that allow the pillow to be secured, for example, to the limb of a person (e.g., arm, etc.).

Previously, conventional travel pillows were configured as neck pillows with a U-shaped design, as shown in FIG. 1. The U-shaped design allowed the pillow to surround a user's neck. Typically, the U-shaped configuration is used in situations where the user of the pillow (e.g., a traveler) is forced to sit upright, typically without area to lay down her head. However, the U-shaped travel pillow is not configured to provide a resting area for the user's head but instead merely provides support for the user's neck. Further, the U-shaped design lacks a cushioning area configured for use between the user' head and a stationary object, such as a table top, mattress, tray table, etc. As such, a need exists for a pillow that can be secured to a user but is configured to (1) be used in positions other than an upright seating position, and/or (2) attach to a user's limb.

SUMMARY

The present invention, as described herein, addresses the problems described above and other problems of prior art systems and methods which will become apparent to one skilled in the art from the description below. Generally, the present invention provides a pillow that may be secured to the user. For example, the securable pillow system may comprise an internal sleeve that bisects the pillow, thereby providing a cavity for the user to insert an arm. Further, the user of the pillow may rest her head on the pillow while the pillow is secured to her arm.

In one embodiment of a securable pillow, the system further includes at least a first layer and a second layer. In between the first and second layers there may be a padding (e.g., filler) such as polyfil, memory foam, or other known textile padding. Further, the first or second layers may each be made of a padded material.

In one or more embodiments of a securable pillow, the sleeve may also be located between each of the at least one first and second layers. In many embodiments, the padding surrounds the outside of the sleeve (e.g., cavity).

In one or more embodiments of a securable pillow, the sleeve (e.g., cavity) shares a length substantially the same as the diameter of each of the first and second layers, so that the sleeve does not extend past the outer perimeter of each of the first and second layers when the three components are sewn together.

In one or more embodiments of the securable pillow, the sleeve and each of the first and second layers are attached together, frequently along a portion of the perimeter of each layer and the openings of the sleeve. In many embodiments, the sleeve and each of the first and second layers are sewn together.

In one or more embodiments of the securable pillow, the sleeve is centered between each of the first and second layers are attached together. In other embodiments, the sleeve is not centered between each of the first and second layers are sewn together.

In one or more embodiments of a securable pillow, the sleeve has parallel sides extending between two openings. In other embodiments, the sleeve has sides that are not parallel between two openings.

In one or more embodiments of a securable pillow, the sleeve (e.g., cavity) has an opening on each end of the pillow. In some embodiments, each opening has a cuff.

In one or more embodiments of a securable pillow, the pillow has a fastener, which may be in addition to the sleeve, or in some embodiments, instead of the sleeve. Like the sleeve, the fastener secures the pillow to the user. In some embodiments, more than one fastener may be used. Further, in some embodiments, one or more fasteners may be used in addition to one or more sleeves.

In one or more embodiments of a securable pillow, the pillow may have a recess or channel, which is not between or covered by either the first or second layer.

In one or more embodiments of the securable pillow, the sleeve is centered between each of the first and second layers. In other embodiments, the sleeve is offset (i.e., not centered) between each of the first and second layers.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Various embodiments of the securable pillow shall be described with reference to FIGS. 2-11. Dimensions of the body of a securable pillow are annotated in terms of $L_1$, $L_2$, and $L_3$. $L_1$ represents the horizontal dimension of a securable pillow, also referred to as the width. $L_2$ represents the vertical dimension of a securable pillow, also referred to as height. $L_3$ represents the thickness of a securable pillow, also referred to as depth.

Figure 1:
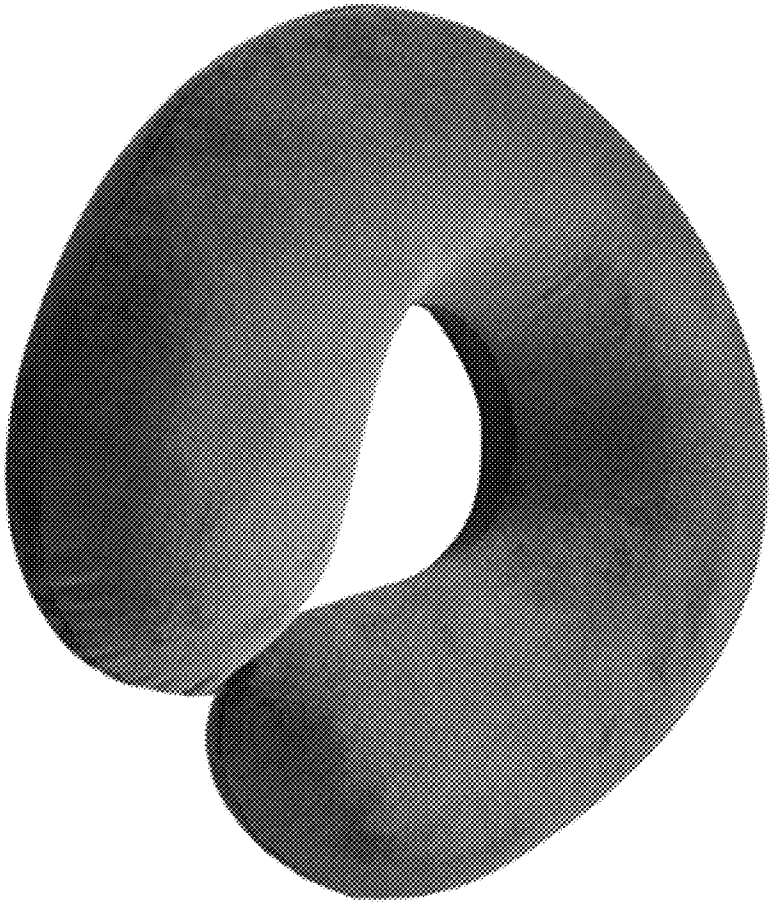
FIG. 1 (PRIOR ART)
FIG. 1 shows a perspective view of a u-shaped travel pillow.
Figure 2A:
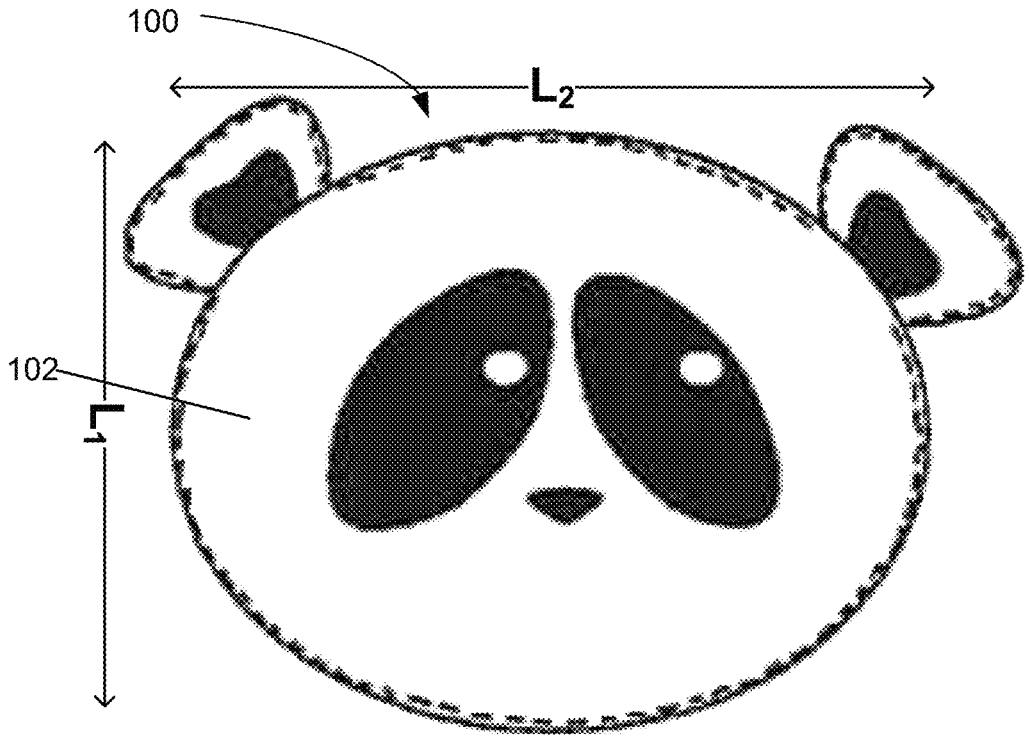
FIGS. 2A-2B is a front view of one embodiment of a first layer and of a second layer of a securable pillow.
Figure 2B:
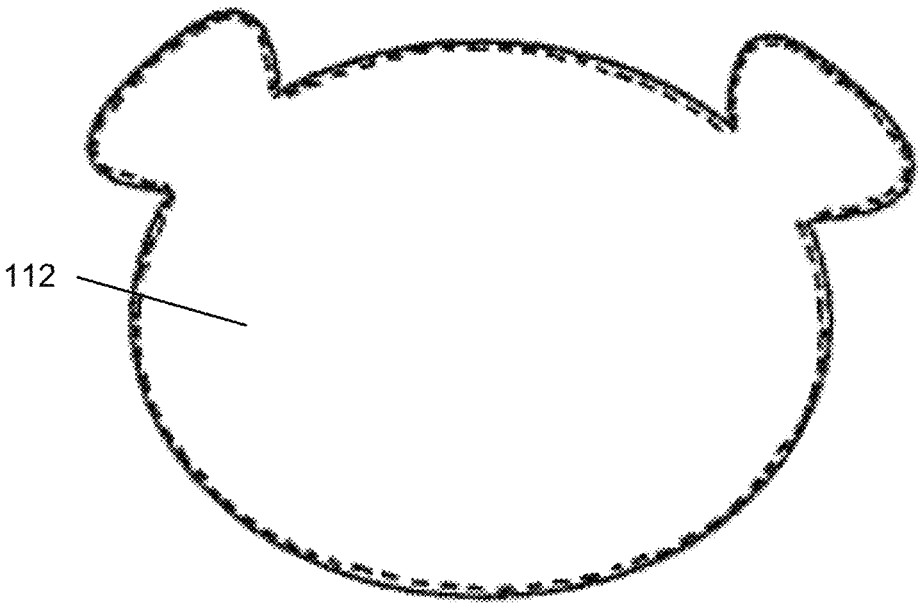

In FIGS. 2A-2B, an exemplary embodiment of a securable pillow 100 may include a first layer 102 and a second layer 112 (collectively, "layers"). In the illustrated example of FIGS. 2A-2B, the layers 102 and 112 are cut to represent the outline of an animal character (e.g., bear, etc.) and have substantially the same height and width, $L_1$ and $L_2$. Other embodiments may instead use other shapes, including without limitation geometric shapes (e.g., square, triangle, etc.) and sports-related shapes (e.g., football, etc.). The layers 102 and 112 may be made out of various known materials. In most embodiments, layers 102 and 112 will be made of a fabric. Such exemplary fabrics may include fabric made out of synthetic fiber (e.g., nylon, etc.), semi-synthetic cellulose fibers (e.g., rayon, modal, lyocell, etc.), plant fiber (e.g., cotton, bamboo, etc.), animal fiber or fill (e.g., wool, feather/down, etc.), or any combination thereof, in order to further enhance the properties of the pillow 100 (e.g., softness, durability, etc.). In some embodiments, layers 102 and 112 may include one or more additional layers. In some embodiments, additional layers may be added to enhance a property lacking in either layer 102 or 112. As one example, a durable fabric may be used for layer 102 while at least one additional layer is made out of softer material and is shaped like and attached to layer 102, and further, the at least one additional layer is configured to be the outside layer that will contact the user. In many embodiments, layers 102 and 112 are attached by stitching 104 (i.e., sewn).

Figure 3A:
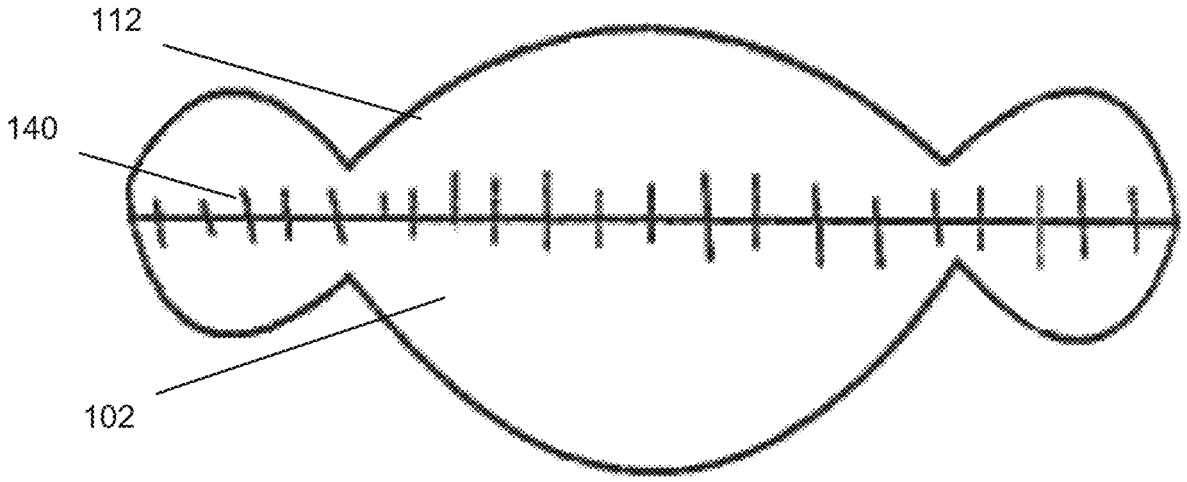
FIGS. 3A-3B shows a top view and a bottom view of a first layer and a second layer sewn together with padding inserted to provide three dimensional shape. The stitching is depicted along with two openings that represent the ends of the sleeve inside the first and second layers.
Figure 3B:
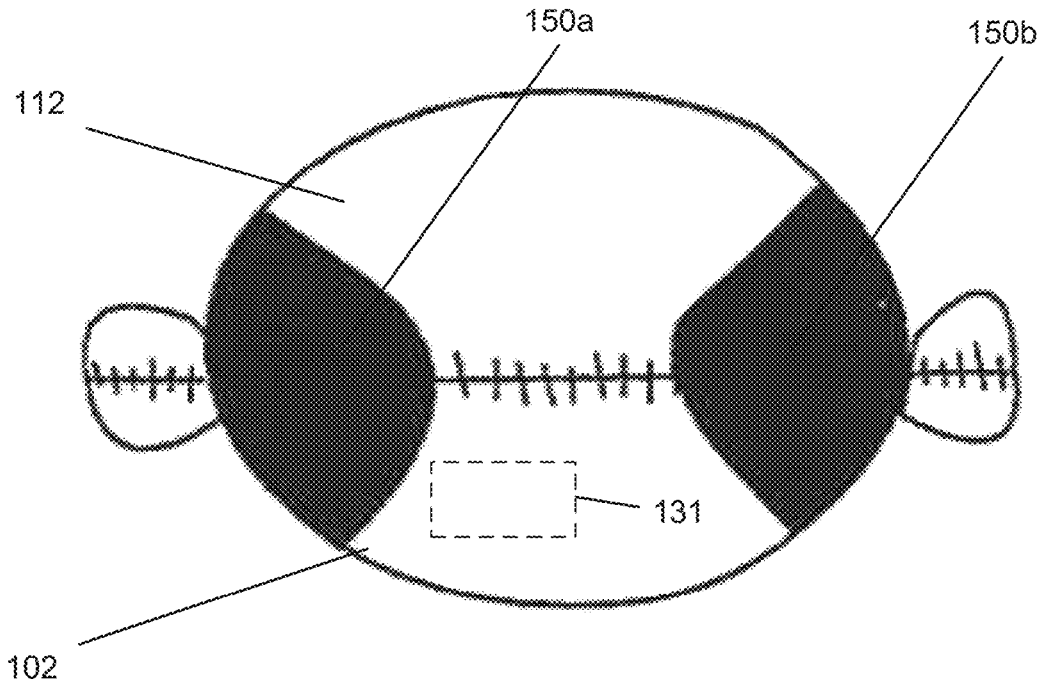

In FIGS. 3A-3B, an exemplary embodiment of a securable pillow 200 has a first layer 102 and a second layer 112, which are sewn together with stitching 104. In some embodiments, a glue or adhesive may be used to attach the various layers, which may be used with or instead of stitching 104. In other embodiments, fasteners such as eyelets, rivets, or other similar mechanical fastening devices may be used to attach used to attach the layers, which may be used with or instead of stitching 104. Layers 102 and 112 have a three dimensional shape because they surround padding 120, not shown. Many embodiments of securable pillow 100 have at least one opening, such as openings 150*a* and 150*b*, formed between layers 102 and 112. In many embodiments, the openings are at the perimeter of layers 102 and 112. The openings allow a user to insert a limb through the securable pillow 100. In many embodiments, openings 150*a* and 150*b* are also the openings of an internal sleeve 130, which runs between layers 102 and 112. In many embodiments, sleeve 130 is sewn to layers 102 and 112. Frequently, sleeve 130 has a width $L_1$ the same or substantially the same as layers 102 and 112. In some embodiments, sleeve 130 is not required, such as when padding 120 is constructed of a material (e.g., a padding mat) that will not fall out of the pillow 100. Sleeve 130 may be made out of any of the materials described above for layers 102 and 112. Alternatively, sleeve 130 may be additional layers sized similar and positioned in between layers 102 and 112 in order to at least, without limitation, retain padding 120. In this configuration, sleeve 130 is configured in a flat configuration (e.g., envelope) instead of a tubular configuration, although openings 150*a* and 150*b* may still be formed with such a flat configuration sleeve 130 through stitching of together of layers 102 and 112. In some embodiments, sleeve 130 is sized to allow a user to insert the securable pillow up to the shoulder/armpit, thereby surrounding the user's upper arm (i.e., bicep/tricep). For example, an average opening may be approximately twelve (12) to thirteen (13) inches, based upon *Anthropometric Reference Data* from the Centers for Disease Control, such as www.cdc.gov/nchs/data/series/sr_11/sr11_252.pdf, which is hereby incorporated by reference in its entirety. In some embodiments, the sleeve 130 and/or openings 150*a-b* are sized for specific ages and/or genders based upon the anthropometric data. In various embodiments, the sleeve 130 may be sized and arranged to allow a user to bend her arm within the sleeve 130 while resting her head on the pillow. A sleeve 130 may be one layer of fabric that is sewn together to form a tube. In other embodiments, a sleeve 130 may be two pieces of fabric sewn together along two opposite edges to form a pouch. In even further embodiments, a sleeve 130 may be assembled out of more than two pieces of fabric to create even further customized shapes. In some embodiments, a pocket(s) 131 may be included for the user's hands. Such pocket 131 may be in sleeve 130, on layer 102 or 112, or an attachment (e.g., extension) of sleeve 130 or layer 102 or 112.

Figure 4:
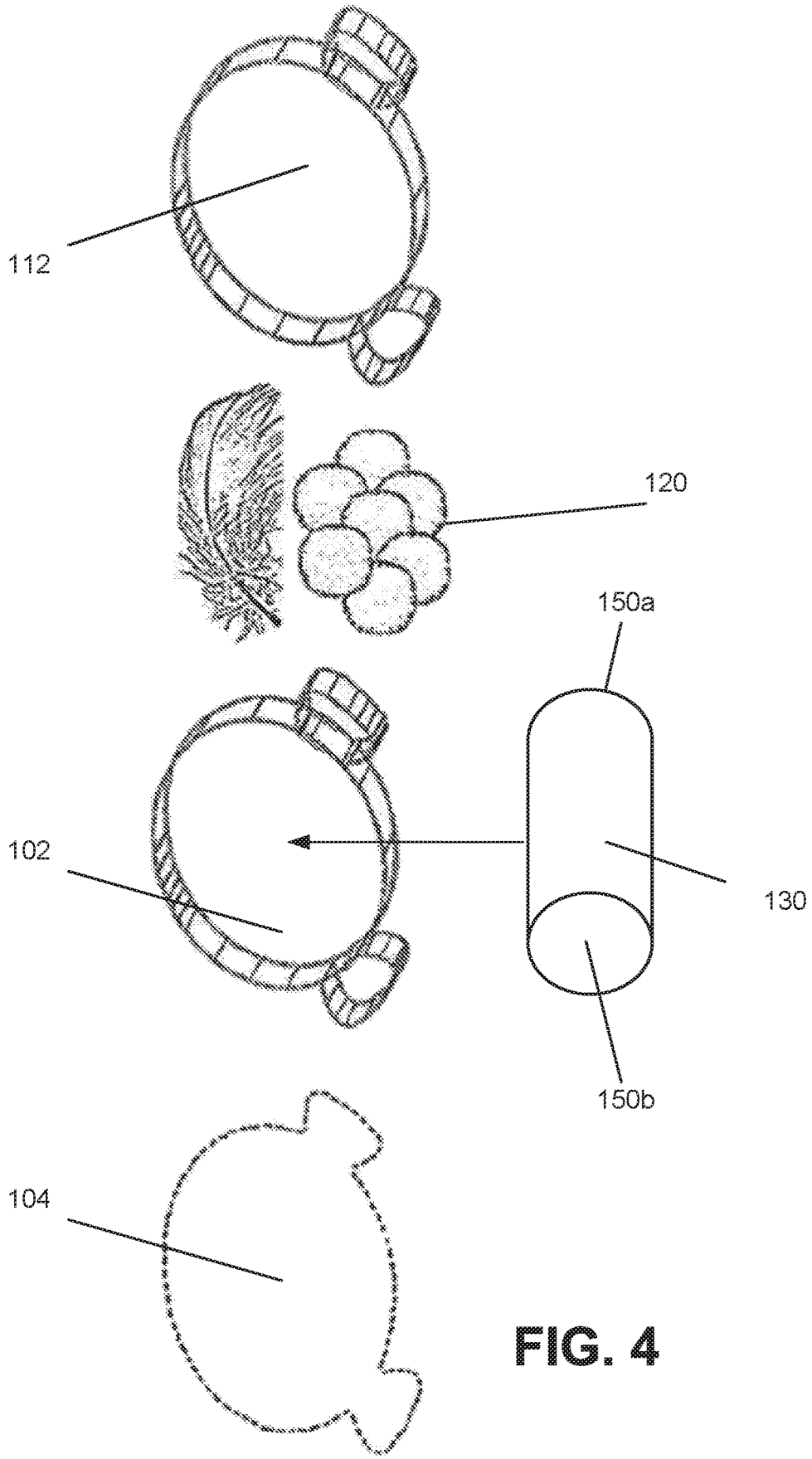
FIG. 4 shows some of the components that may be used to create the securable pillow system.

In FIG. 4, an exemplary embodiment of a securable pillow 300 is shown with some of the components that may be used to create the securable pillow 100. Outer layers 102 and 112 may be attached together with stitching 104. Padding 120 (e.g., polyfill, down, memory foam, etc.) may be inserted between the layers 102 and 112. Optionally, a sleeve 130 may be used to connect openings 150*a-b*, not shown.

Figure 5:
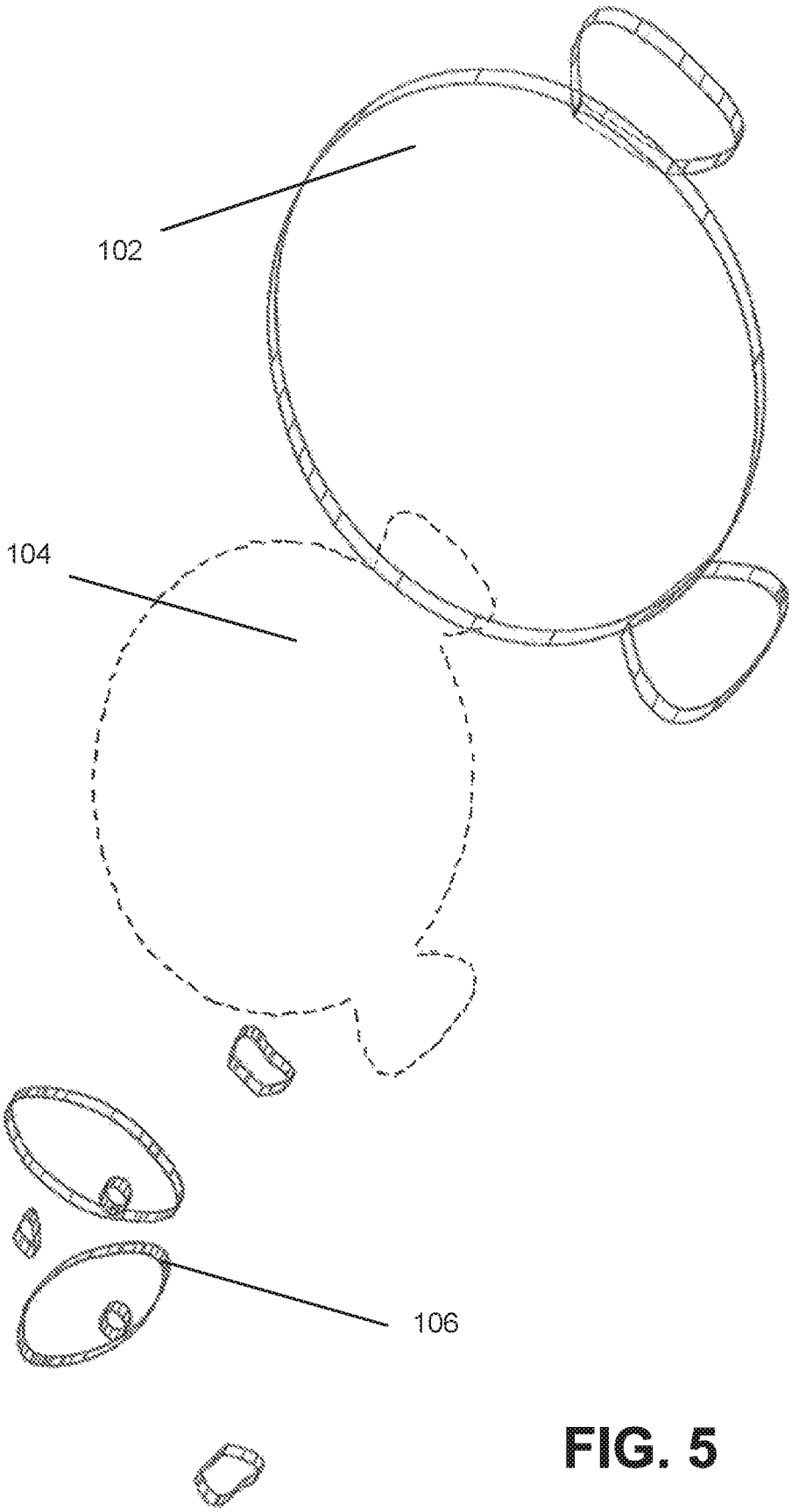
FIG. 5 shows layers that may be used to create designs upon the securable pillow.

In FIG. 5, an exemplary embodiment of a securable pillow 400 includes attachment(s) 106, which may be used to create designs upon the securable pillow. For example, the attachments 106 shown in FIG. 5 provide the design features of the an animal (e.g., bear's face). In various embodiments, the attachment(s) 106 may also be made of one or more layers of fabric, similar to layers 102 and 103. Attachment(s) 106 need not only be fabric; they may also be made of other materials (e.g., plastics).

Figure 6A:
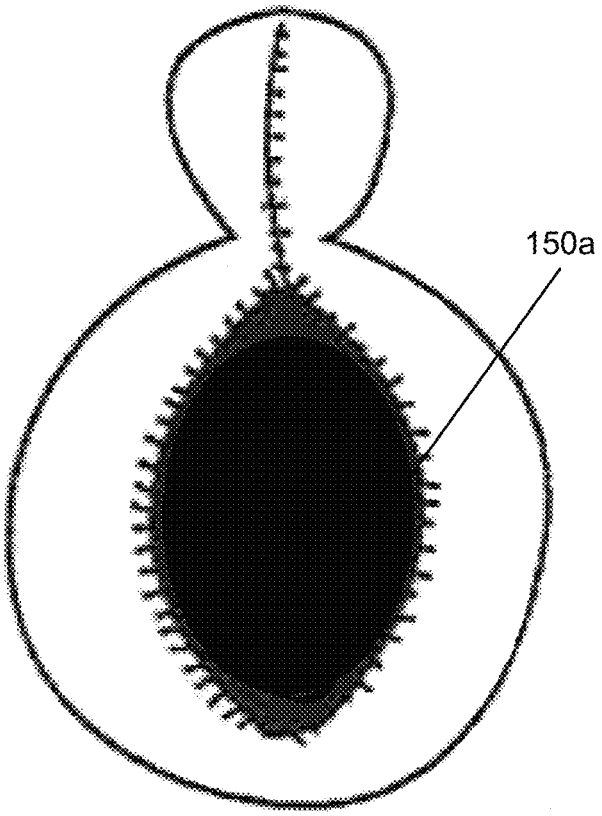
FIGS. 6A-6B shows a side view of two embodiments of a securable pillow system. One embodiment includes extensions (e.g., animal ears) while the other embodiment does not include extensions. Both illustrated embodiments illustrate an opening that represents an end of the sleeve inside the first and second layers.
Figure 6B:
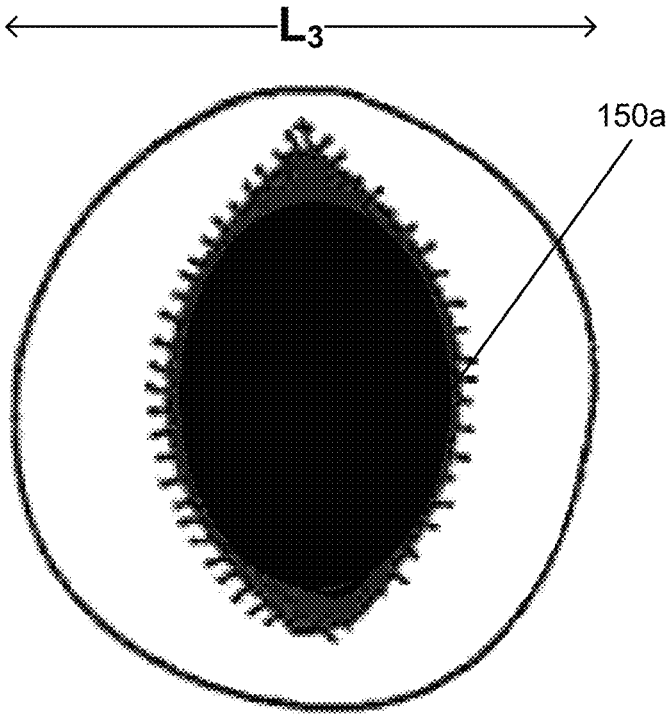

In FIGS. 6A-6B, an exemplary embodiment of a securable pillow 500 shows a side view of two embodiments of a securable pillow. One embodiment includes extensions (e.g., animal ears) while the other embodiment does not include extensions. Both illustrated embodiments show an opening 150*a*, which represents an end of the sleeve inside the first and second layers. In these illustrated embodiments, stitching 104 has been used to connect the opening of sleeve 130 to layers 102 and 112.

Figure 7A:
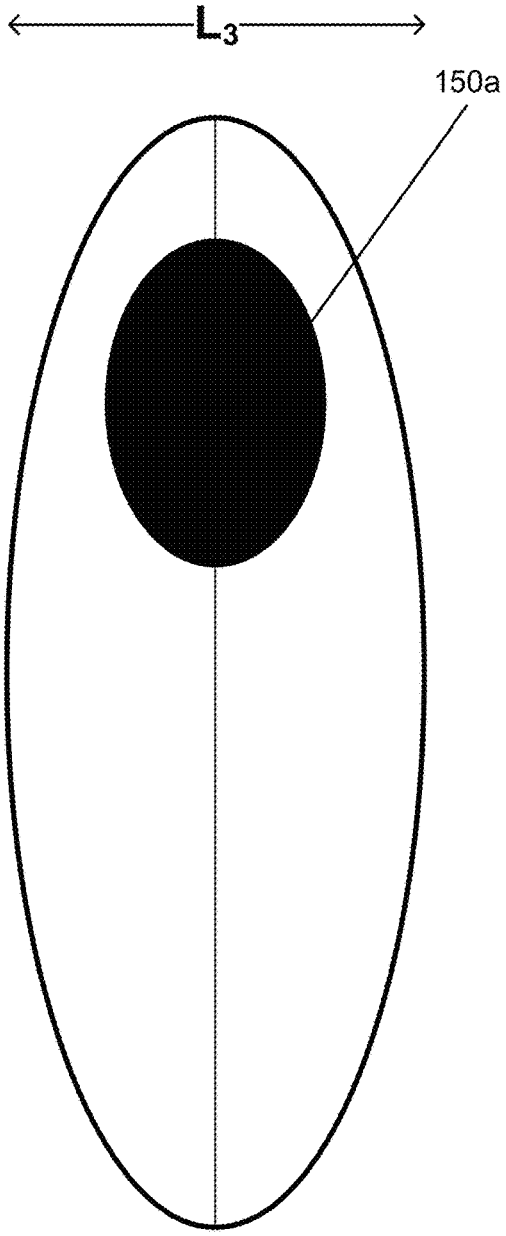
FIGS. 7A-7B shows a side view of a securable pillow, further illustrating an opening that represents an end of the sleeve inside the first and second layers. In some embodiments, the sleeve and/or its openings may be centered, either vertically and/or horizontally. In other embodiments, the sleeve and/or its openings may be offset, either vertically and/or horizontally.
Figure 7B:
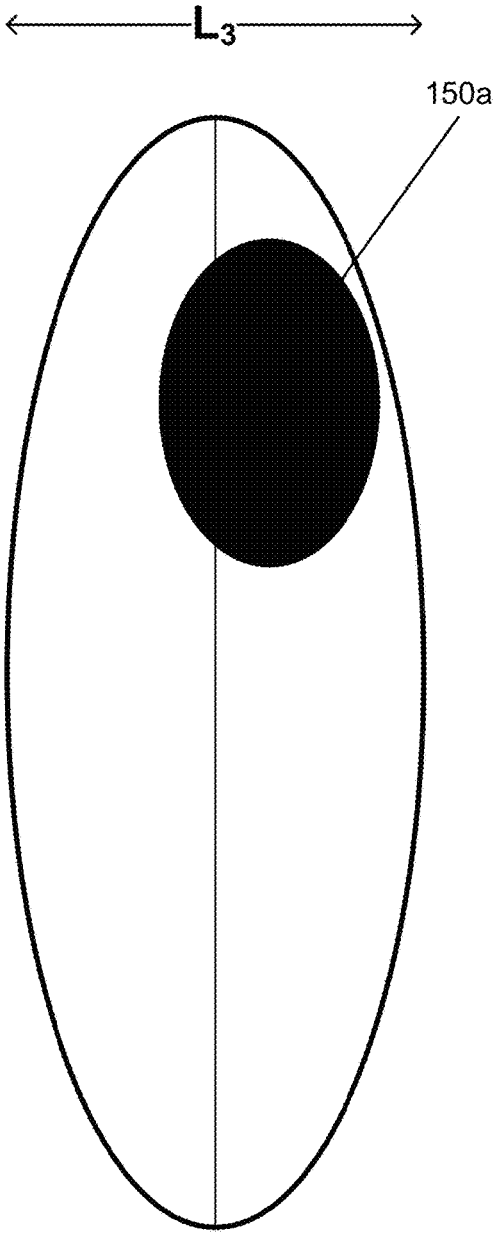

In FIGS. 7A-7B, an exemplary embodiment of a securable pillow 600 is shown with an opening that represents an end of the sleeve relative to layers 102 and 112. In some embodiments, the openings (e.g., 150*a*, 150*b*, etc.) may be centered, either vertically (i.e., $L_2$) and/or in depth ($L_3$). In other embodiments, the sleeve and/or its openings may be offset, either vertically and/or horizontally. For example in FIG. 7A, the opening 150*a* is centered in relation to $L_3$ but offset in relation to $L_2$ of a securable pillow 600. In FIG. 7B, the opening 150*a* is offset in relation to both $L_2$ and $L_3$.

Figure 8A:
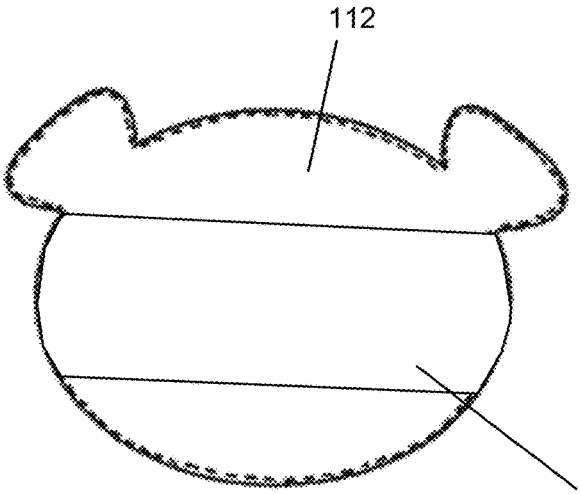
FIGS. 8A-8C shows cross sections of different embodiments of a securable pillow in which the sleeve bisects the first and second layers. Only the second layer is shown in order to show the relative location of the sleeve.
Figure 8B:
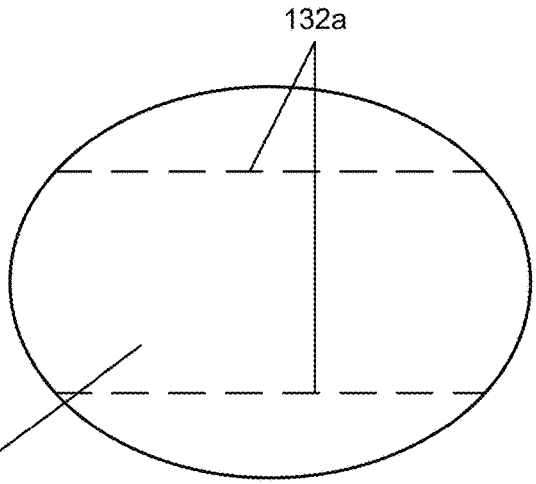
Figure 8C:
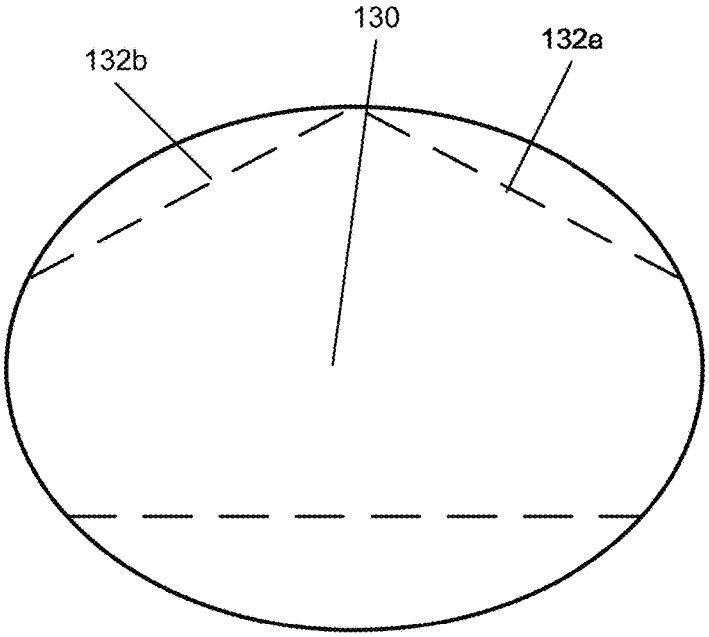

In FIGS. 8A-8C, an exemplary embodiment of a securable pillow 700 is shown with cross sections in which the sleeve bisects the first and second layers, 102 and 112. Only the second layer 112 is shown in order to show the relative location of the sleeve. As shown in FIG. 8A, stitching 104 is not used to connect layers 102 and 112 together where the sleeve has openings (e.g., 150*a*, 150*b*, etc.). In many embodiments, sleeve 130 has two substantially parallel sides 132*a* along $L_1$, as shown in FIGS. 8A and 8B. FIG. 8C illustrates a sleeve 130 without parallel side. Instead, sides 132*b* and 132*c* create an angle, and thereby, widens the sleeve 130 between openings 150*a* and 150*b*. This widening may allow a user to bend her arm while using the securable pillow 700. It should be understood that the widening of a sleeve 130 does not have to be centered between openings 150*a* and 150*b*. Further, the widening does not have to be at a distinct corner, such as the corner shown between sides 132*b* and 132*c*. Instead, the widening of sleeve may be a curve 132*d* (as shown FIGS. 9A-9B), a bulge, or an extension.

Figure 9A:
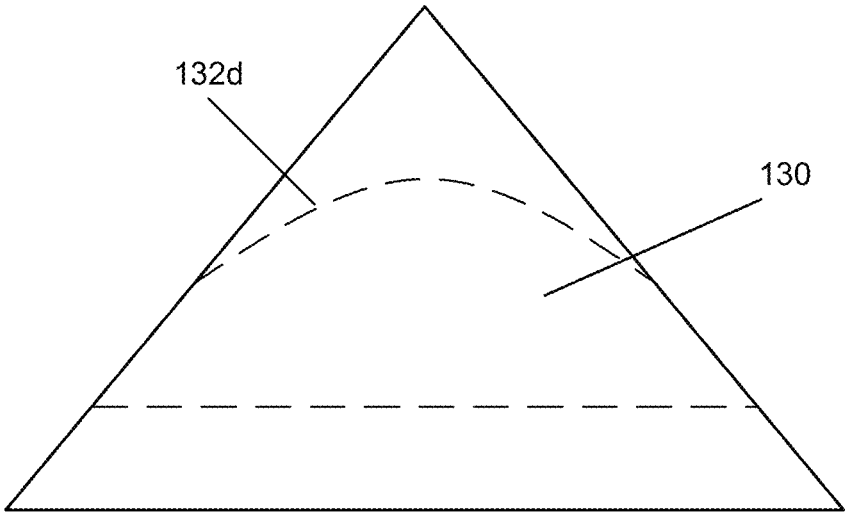
FIGS. 9A-9B show different embodiments of the shape of a securable pillow as well as different embodiments of the sleeve.
Figure 9B:
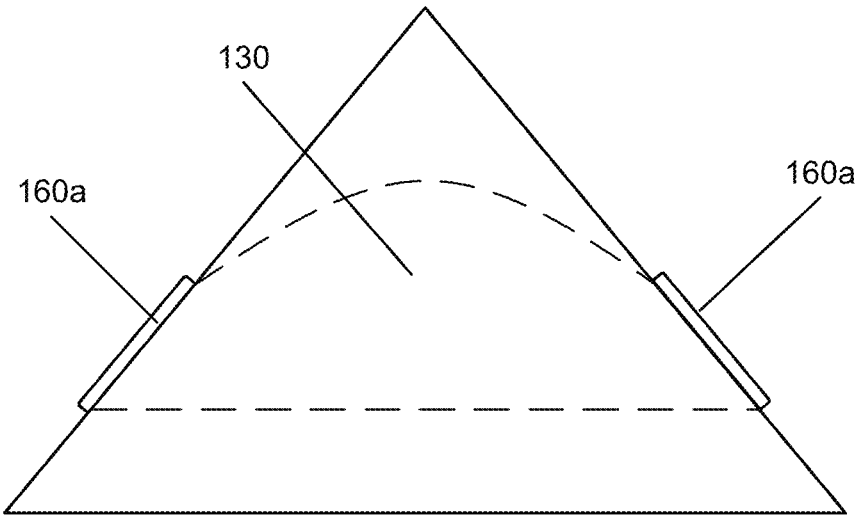

In FIGS. 9A-9B, an exemplary embodiment of a securable pillow 800 is shown in different shapes as well as different embodiments of the sleeve. For example, a securable pillow 800 may be triangular in shape, which may be preferred if the user's arm is bent. FIG. 9B illustrates that openings 150*a* and 150*b* may include cuffs 160*a* and 160*b*. In some embodiments, the cuffs have some elasticity to constrict around the user's limb, which may help secure the pillow to the user.

Figure 10A:
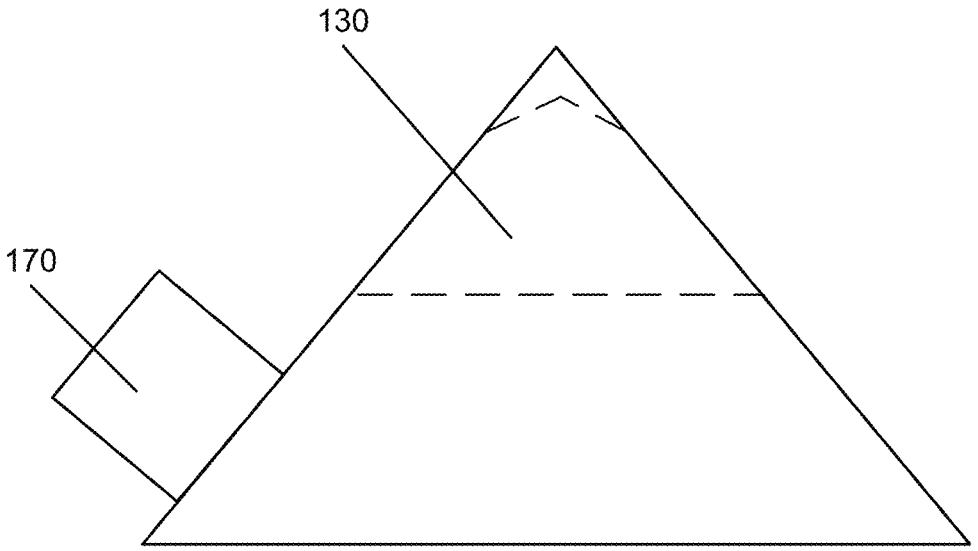
FIGS. 10A-10C show different embodiments of fasteners, sleeves, and shelves configured into a securable pillow.
Figure 10B:
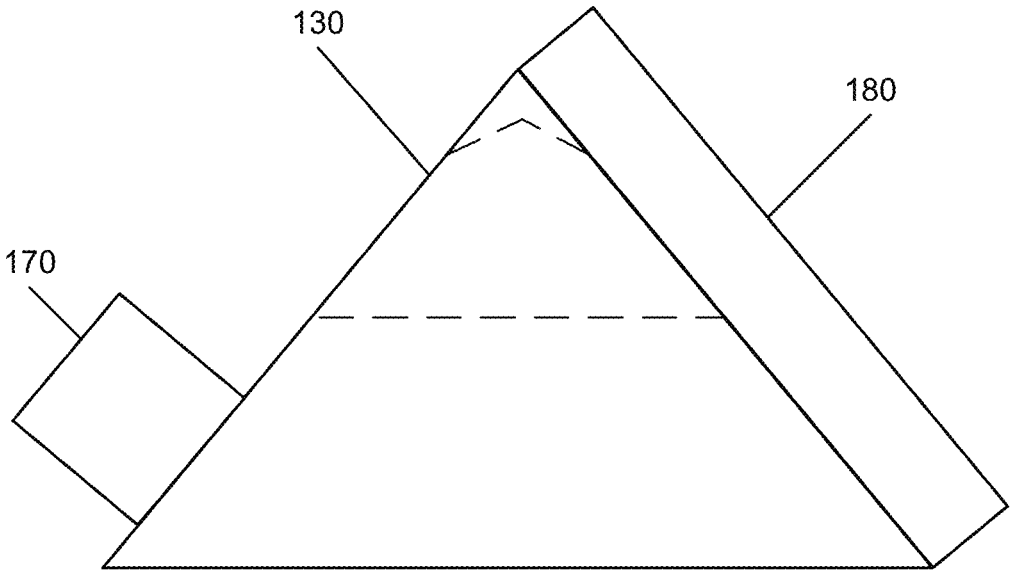
Figure 11:
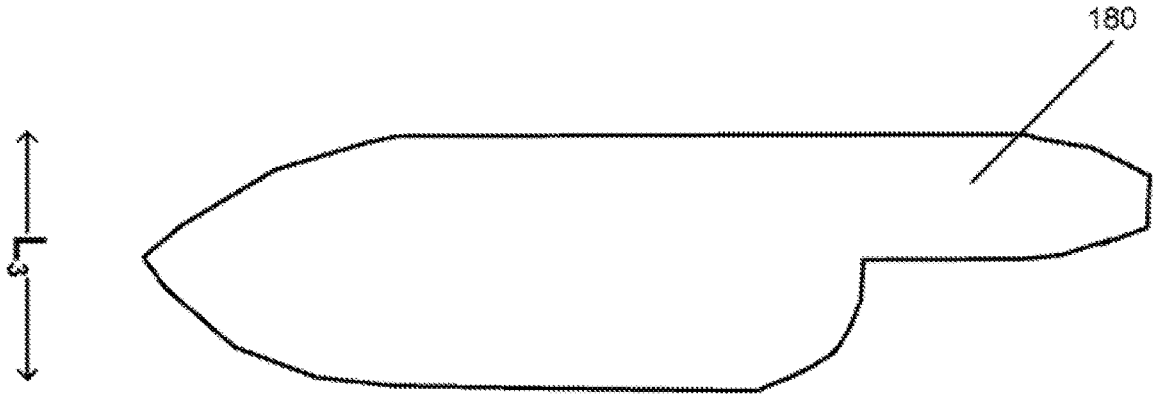
FIG. 11 shows a side view of one of a shelf configured into a securable pillow.
Figure 10C:
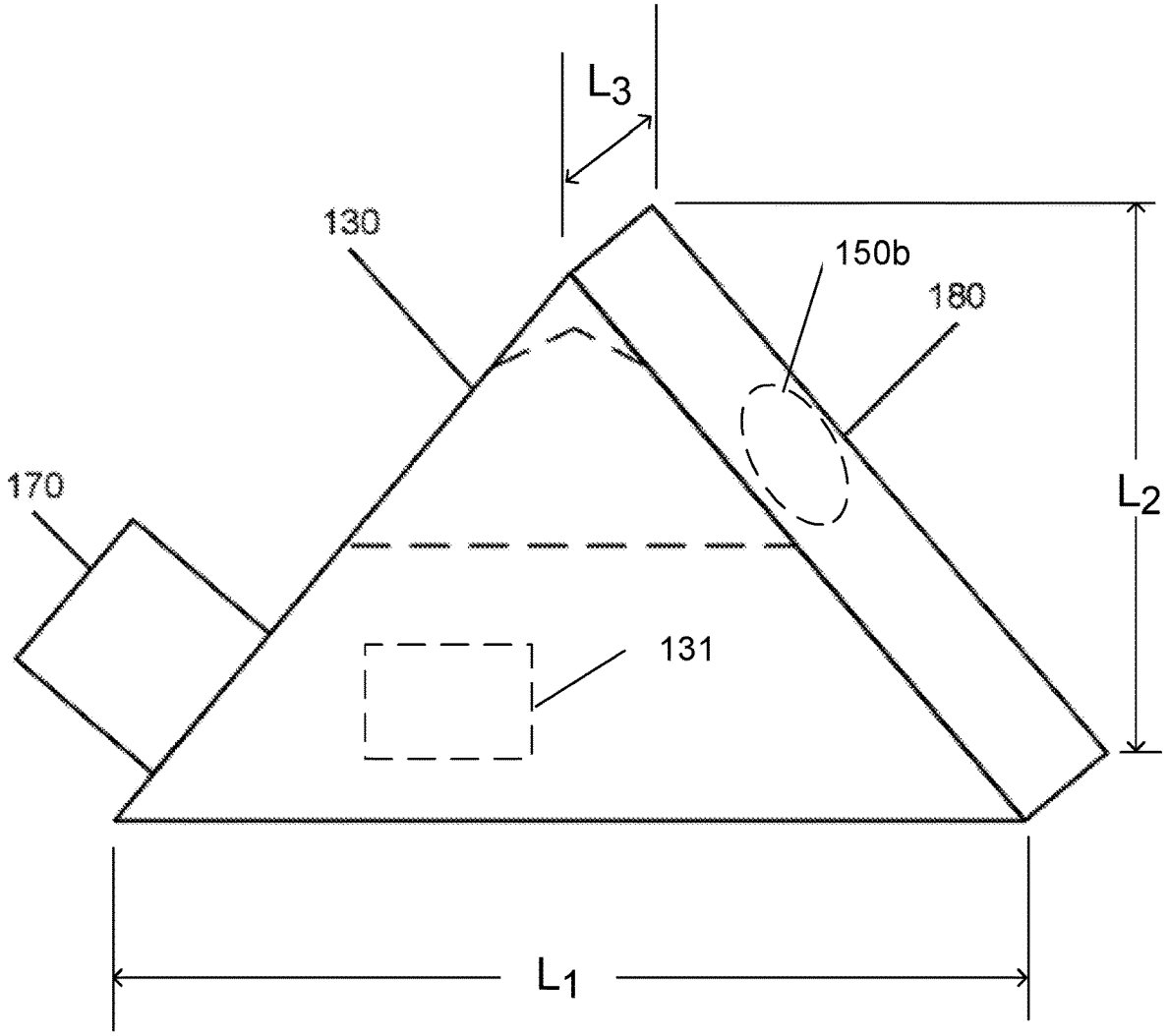

In FIGS. 10A-10C, an exemplary embodiment of a securable pillow 900 shows various embodiments of fasteners, sleeves, and shelves configured into a securable pillow. Fastener 170 is similar to sleeve 130, except that it is not between layers 102 and 112. Instead, it is external and attached to the perimeter of layers 102 and 112. In the illustrated embodiment, fastener 170 is attached adjacent to the opening 150*a* of sleeve 130. In some embodiments, fastener 170 is configured to surround a user's upper arm while sleeve 130 is configured to surround the user's elbow or forearm. Shelf 180 is a portion of a securable pillow which has a smaller depth (i.e., L3) than the other portions of the securable pillow. In the embodiment of FIG. 10B, the shelf 180 extends along one edge of the securable pillow, but may extend along multiple edges. Also shown in the exemplary illustrated embodiment of FIG. 10B, opening 150*b* is shown opening underneath shelf 180. However, in some embodiments, shelf 180 may be configured to only be adjacent to opening 150*b* (or 150*a*) and not overlap. In the embodiment of FIG. 10C, the openings (e.g., 150*a*, 150*b*, etc.) may be centered, either vertically (i.e., $L_2$) and/or in depth ($L_3$). Additionally, in the embodiment of FIG. 10C a pocket 131 is shown. Another embodiment of a securable pillow with a shelf 180 is shown in FIG. 11 from the side perspective. The recess created underneath shelf 180 may create space for the user's arm, such as the user's forearm. In many such configurations, shelf 180 provides padding on top of the user's arm. In the two illustrated embodiments of FIGS. 10B and 11, shelf 180 is adjacent to the perimeter of a securable pillow. However, in some embodiments, shelf 180 may be located between two wider regions a securable pillow, thereby creating a channel (not shown) for the user's arm. As such, various combinations of sleeves 130, fasteners 170, and channels may be used to secure a pillow to a user's arm. Shelf 180 may be comprised of a portion of layer 102 and/or layer 112, or alternatively, may be attached to such layers.

Although the present disclosure and its advantages have been described in detail, it should be understood that various changes, substitutions and alterations can be made herein without departing from the spirit and scope of the disclosure as defined by the appended claims. It should be noted that any of the various feature(s) disclosed in the detailed description may be excluded from any one of the various embodiments (i.e., a negative limitation of a particular feature) for the purpose of reducing cost, reducing complexity, increasing breathability, distinguishing from other methods and/or systems, and/or removing duplicative features that may be provided by a separate method or system, especially when the other method or system is connected with the present method and/or system. Further, various industries will require different combinations of the various features of the disclosed invention, and in particular, may need to limit or exclude certain features (i.e., a negative limitation of a various feature). Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A pillow comprising:

a first outer layer including a first exposed outer facing surface and having a first outer perimeter;

a middle layer;

a second outer layer including a second exposed outer facing surface and having a second outer perimeter, the second outer layer different from the first outer layer, the middle layer positioned between the first outer layer and the second outer layer, wherein the first outer layer is coupled to the second outer layer such that a first portion of the first outer perimeter and a first portion of the second outer perimeter form a first pillow opening of the pillow, and a second portion of the first outer perimeter and a second portion of the second outer perimeter form a second pillow opening of the pillow; and a sleeve that extends between the first outer layer and the second outer layer and has two sleeve openings, the two sleeve openings including a first sleeve opening at a first end of the sleeve and a second sleeve opening at second end of the sleeve, wherein the first pillow opening and the first sleeve opening are joined at a first seam that includes a first portion of the first sleeve opening and the first portion of the first outer perimeter of the first outer layer that are sewn together, and includes a second portion of the first sleeve opening and the first portion of the second outer perimeter of the second outer layer that are sewn together, and wherein the first pillow opening and the first sleeve opening are joined to form a single opening;

wherein the second pillow opening and the second sleeve opening are joined at a second seam that includes a first portion of the second sleeve opening and the second portion of the first outer perimeter of the first outer layer that are sewn together, and includes a second portion of the second sleeve opening and the second portion of the second outer perimeter of the second outer layer that are sewn together; and wherein the second pillow opening and the second sleeve opening are joined to form a single opening;

wherein the first outer layer is coupled to the second outer layer at a third seam that includes a third portion of the first outer perimeter and a third portion of the second outer perimeter, the third portion of the first outer perimeter positioned between the first portion and the second portion of the first outer perimeter, and the third portion of the second outer perimeter positioned between the first portion and the second portion of the second outer perimeter;

a fastener coupled to the third seam such that the fastener is attached to the third portion of the first outer perimeter of the first outer layer and to the third portion of the second outer perimeter of the second outer layer such that the fastener is attached adjacent to and spaced apart from the first sleeve opening and is distinct from the first pillow opening and the second pillow opening; and wherein, during use by a user, the fastener is configured to surround a first portion of an arm of the user while the sleeve is configured to surround a second portion of the arm of the user.

2. The pillow of claim 1, in which the sleeve comprises at least one additional layer, the at least one additional layer distinct from the first outer layer and distinct from the second outer layer.

3. The pillow of claim 1, in which the middle layer comprises padding that surrounds the sleeve, and further comprising a pocket in the sleeve and configured for a user's hand.

4. The pillow of claim 3, in which the first outer perimeter of the first outer layer and the second outer perimeter of the second outer layer have the same shape.

5. The pillow of claim 4, in which the two openings of the sleeve are centered in a first dimension and a second dimension through the center of the pillow.

6. The pillow of claim 3, in which the two sleeve openings are not centered through the center of the pillow, either vertically or horizontally.

7. The pillow of claim 3, in which the sleeve widens between the two sleeve openings.

8. The pillow of claim 7, in which the sleeve widens enough to allow an elbow of a person to bend 90 degrees within the sleeve.

9. The pillow of claim 5, in which the sleeve is not centered through the pillow in a third dimension.

10. The pillow of claim 1, wherein, the first portion of the arm of the user comprises an upper arm and the second portion of the arm of the user comprises an elbow or a forearm.

11. The pillow of claim 10, wherein the first outer layer and the second outer layer define a shelf that extends along at least one edge.

12. The pillow of claim 1, wherein the sleeve defines a cavity that extends between the two sleeve openings.

13. The pillow of claim 12, further comprising a pocket coupled to the sleeve, wherein the pocket is positioned within the cavity.

14. The pillow of claim 5, wherein the first outer layer is further coupled to the second outer layer at a fourth seam that includes a fourth portion of the first outer perimeter and a fourth portion of the second outer perimeter, the fourth portion of the first outer perimeter distinct from the third portion of the first outer perimeter and positioned between the first portion and the second portion of the first outer perimeter, and the fourth portion of the second outer perimeter distinct from the third portion of the second outer perimeter and positioned between the first portion and the second portion of the second outer perimeter.

15. The pillow of claim 1, further comprising:

a pocket coupled to the first outer layer.

16. The pillow of claim 14, wherein the sleeve includes a first sleeve layer and a second sleeve layer, the first sleeve layer coupled to the second sleeve layer by a fifth seam that extends between the two sleeve openings and by a sixth seam that extends between the two sleeve openings.

17. The pillow of claim 1, wherein the sleeve defines a cavity that extends between the two sleeve openings, and further comprising a pocket that is an extension of the sleeve.

18. A pillow comprising:

a first outer layer including a first exposed outer facing surface and having a first outer perimeter;

a second outer layer coupled to and different from the first outer layer, the second outer layer including a second exposed outer facing surface and having a second outer perimeter;

a sleeve that extends between the first outer layer and the second outer layer, the sleeve comprising:

a first end that defines a first sleeve opening and that is connected to each of the first outer layer and the second outer layer; and a second end that defines a second sleeve opening and that is connected to each of the first outer layer and the second outer layer;

wherein the first outer layer is connected to the second outer layer at a seam that extends between the first sleeve opening and the second sleeve opening; and a fastener configured to receive an arm of a user, the fastener coupled to the seam such that the fastener is attached to the first outer layer and the second outer layer, attached adjacent to and spaced apart from the first sleeve opening, and is spaced apart from the second sleeve opening; and wherein, during use by the user, the fastener is configured to surround a first portion of the arm of the user while the sleeve is configured to surround a second portion of the arm of the user.

19. The pillow of claim 18, wherein:

the sleeve defines a cavity that extends between the first sleeve opening and the second sleeve opening;

the first portion comprises an upper arm; and
the second portion comprises an elbow or a forearm.

* * * * *